US008713813B2

(12) United States Patent
Sans Rovira

(10) Patent No.: US 8,713,813 B2
(45) Date of Patent: May 6, 2014

(54) INDUSTRIAL LAUNDRY DRIER WITH FILTER CLEANING DEVICE

(75) Inventor: Ramon Sans Rovira, Vic (ES)

(73) Assignee: GIRBAU, S.A. (ES)

( * ) Notice: Subject to any disclaimer, the term of this patent is extended or adjusted under 35 U.S.C. 154(b) by 336 days.

(21) Appl. No.: 13/201,328

(22) PCT Filed: Dec. 23, 2009

(86) PCT No.: PCT/ES2009/000595

§ 371 (c)(1),
(2), (4) Date: Sep. 30, 2011

(87) PCT Pub. No.: WO2010/092195

PCT Pub. Date: Aug. 19, 2010

(65) Prior Publication Data

US 2012/0036730 A1 Feb. 16, 2012

(30) Foreign Application Priority Data

Feb. 16, 2009 (ES) ..... 200900420

(51) Int. Cl.
*F26B 19/00* (2006.01)

(52) U.S. Cl.
USPC ..... 34/60; 34/82; 34/85; 134/42; 68/13 R; 68/18 C; 8/149.3; 15/339

(58) Field of Classification Search
USPC ..... 34/82, 60, 86, 85, 87, 90, 595, 600, 34/601, 606, 610; 134/42; 68/5 C, 13 R, 68/18 C, 20; 8/137, 149.3, 159; 15/314, 15/315, 339
See application file for complete search history.

(56) References Cited

U.S. PATENT DOCUMENTS

| | | | | |
|---|---|---|---|---|
| 2,596,210 | A * | 5/1952 | Cogshall | 200/61.6 |
| 4,593,481 | A | 6/1986 | Pellerin | |
| 5,535,478 | A | 7/1996 | Thompson | |
| 5,893,194 | A * | 4/1999 | Karmel | 15/314 |
| 5,904,160 | A * | 5/1999 | Wright | 134/21 |
| 6,481,047 | B1 * | 11/2002 | Schaefer | 15/314 |
| 7,325,332 | B2 * | 2/2008 | Chung et al. | 34/602 |
| 7,658,804 | B1 * | 2/2010 | Cano | 134/8 |
| 8,001,650 | B2 * | 8/2011 | Trotter | 15/315 |
| 2006/0123652 | A1 | 6/2006 | Chung | |

(Continued)

FOREIGN PATENT DOCUMENTS

| | | | |
|---|---|---|---|
| DE | 3817849 | A1 | 12/1989 |
| EP | 0163879 | A1 | 12/1985 |

(Continued)

*Primary Examiner* — Steve M Gravini
(74) *Attorney, Agent, or Firm* — Hess Patent Law Firm LLC; Robert J. Hess

(57) ABSTRACT

The industrial tumble dryer comprises a casing (1) enclosing a drum (2) to contain the clothes to be dried by means of drying air introduced into it, a low-pressure chamber (3) to extract drying air from the drum (2) and a filtering device (4) interposed in the low-pressure chamber (3). The filtering device (4) comprises a filtering element (5), means to detach fuzz from said filtering element (5) and a build-up enclosure (6) to collect the detached fuzz. In the casing (1) there is an opening (7) communicated with the build-up enclosure (6) and configured to receive a suction nozzle (8*a*) of an external suction device (8) to remove the fluff from the build-up enclosure (6) through suction without the need to remove the filtering element (5) or to access it.

6 Claims, 4 Drawing Sheets

(56) References Cited

U.S. PATENT DOCUMENTS

| | | | | |
|---|---|---|---|---|
| 2009/0235549 | A1* | 9/2009 | Cartwright | 34/92 |
| 2012/0036730 | A1* | 2/2012 | Sans Rovira | 34/85 |

FOREIGN PATENT DOCUMENTS

| | | | |
|---|---|---|---|
| JP | 3026299 | A | 2/1991 |
| JP | 7116388 | A | 5/1995 |
| JP | 7136396 | A | 5/1995 |
| JP | 7163793 | A | 6/1995 |
| JP | 7204398 | A | 8/1995 |
| JP | 2008006044 | A | 1/2008 |
| WO | 2008086875 | A1 | 7/2008 |
| WO | 2010092195 | A1 | 8/2010 |

* cited by examiner

INDUSTRIAL LAUNDRY DRIER WITH FILTER CLEANING DEVICE

FIELD OF THE ART

The present invention relates to an industrial tumble dryer provided with a device that allows the elimination of fluff from the filter without the need to remove or to access the filter.

BACKGROUND OF THE INVENTION

There are known tumble dryers of the type comprising a casing supporting an enveloping wall inside which a rotating drum with perforated walls is installed for containing clothes to be dried, and air-heating means in combination with a turbine or the like to impel hot air in a radial direction of the drum through its perforated walls towards an exhaust duct through which the hot air from the drum is expelled outside. An air filter is arranged in said exhaust duct to retain the fluff released by the clothes and suspended in the hot air. Tumble dryers of another type are also known, for instance through U.S. Pat. No. 4,593,481, wherein the air-heating means and the turbine are arranged to at least partially impel hot air in the axial direction of the drum and towards the exhaust duct wherein the filter is located. In both types of tumble dryer, the fluff resulting from the filtering of hot air gradually builds up in the filter, and this hinders air circulation, diminishes the efficiency of the dryer and is detrimental to the mechanical elements, so that it is recommended that the filter be cleaned at least after two or three tumbling cycles. The filter is generally accessible and/or removable to proceed to its cleaning, but this is a time-consuming operation. In domestic applications, wherein there is usually one single tumble dryer carrying out an average of one tumbling cycle per day, the time required to clean the filter is readily acceptable. However, in industrial applications wherein there can be a set of several tumble dryers, each carrying out up to sixteen or more tumbling cycles per working shift, the time required for the repeated cleaning of the filters and the economic cost it involves are hardly assumable.

Patents EP-A-0163879 and DE-A-3817849 describe different dry-cleaning machines, which are also subject to the fluff problem, endowed with suction nozzles connected to an external suctioning static installation. The internal suction nozzles are connected to mechanisms that move them in a proximity relationship with the filter while the suction flow is on to dislodge and remove the fluff from the filter. This solution involves a large economic cost, since it is mechanically complex and requires an external vacuum-generating installation and an external network of fixed suction ducts. In addition, the suction nozzle-moving mechanisms are immediately adjacent to the filter wherein the fluff builds up, and they can be negatively affected by the fluff build-up.

Patent JP-A-7-163793 describes a domestic tumble dryer provided with a filtering device designed in such a way that it can be manually cleaned using an external vacuum cleaner of a conventional type without the need to disassemble the filter, wherein the filtering device is arranged in the bottom of the drum and access thereto by means of the suction nozzle of the vacuum cleaner is carried out through the load/unload door of the drum. One inconvenience is that carrying out the filter cleaning first requires accessing the filter by means of the suction nozzle through the open load/unload door when the drum is empty and then go through the various areas of the filter with the nozzle, which takes up a time during which other operations, such as the loading/unloading of clothes into/from the drum cannot be carried out.

U.S. Pat. No. 7,325,332 discloses a domestic tumble dryer wherein the filtering device includes a cavity with slots wherein a filter is removably installed. With the tumble dryer, a connecting unit is provided that can be located in said slots of the device in place of the filter when the latter has been removed, and said connecting unit is configured to be connected to the suction nozzle of a vacuum cleaner for cleaning the hot air exhaust duct of the tumble dryer. Access to the filtering device is carried out through the load/unload door of the drum when it is open, and when the filter has been removed, whereby the cleaning operation must be carried out consuming some time while the tumbling cycle is stopped or between two tumbling cycles.

There are known tumble dryers provided with a filter that can be easily removed through an access different from the load/unload door of the drum, and the removed filter can be cleaned by any means, obviously including an external vacuum cleaner. However, the need to extract the filter to effect its cleaning requires a relatively long time and involves the risk of scattering the fluff in the surrounding environment.

U.S. Pat. No. 5,535,478 discloses a suction device provided with a flexible suction nozzle for cleaning a cavity wherein there is housed the air filter of a domestic tumble dryer from which the filter has been previously removed. The suction nozzle is especially configured with rough edges and lateral and end suction openings to carry out a dual function: a scraping action of the cavity walls by means of said rough edges in order to dislodge the fluff attached to them and a suctioning function by means of said lateral and end openings to remove the detached fluff. One inconvenience is that the suction nozzle of the suction device has a specific design corresponding to the cavity of the filter of the tumble dryer and, in addition, it is required the previous withdrawal of the filter for it to be able to carry out the cleaning of the cavity where the filter is housed.

International patent application WO-A-2008086875 discloses a domestic tumble dryer provided with an air filter connected to a vibrating device that can be turned on to detach the fluff from the filter. The detached fluff falls by gravity into a container that can be periodically removed to empty it. The activation of the vibrating device must be carried out when the tumbling airflow is stopped, since the detached fluff would otherwise be impelled again by the airflow against the filter. The need to remove the container from the tumble dryer for cleaning has the inconveniences described above in relation to the need of removing the filter.

Since they do not have the space limitation of domestic tumble dryers, industrial tumble dryers generally have a casing with three overlaying regions: an upper region wherein air-heating means are housed, a middle region wherein the tumbling drum is located, and a lower region, wherein a low-pressure chamber through which hot air circulates coming from said tumbling drum is located and also having means to create said low pressure so as to cause the circulation of air towards an exhaust, and a filtering device in an air passage towards the low-pressure chamber. Tumble dryers of this type are known wherein the filtering device has the shape of a drawer provided with filtering walls where the air circulates from the inside out, so that the fluff is retained within the drawer. This drawer can be removed to clean the built-up fluff from the inner surfaces of the filtering walls. This device has, however, the inconvenience of consuming time and the risk of scattering fluff in the surrounding environment.

DISCLOSURE OF THE INVENTION

One objective of the present invention is to provide an industrial tumble dryer provided with a device that allows for the cleaning of the filter using an external suction device without the need of removing the filter or accessing it with the suction nozzle of the suction device.

The present invention contributes to reach the above and other objectives by providing an industrial tumble dryer comprising a casing wherein there are a tumbling drum configured to hold clothes to be dried by means of drying air introduced into it, a low-pressure chamber to draw in drying air from said drum and an air-filtering device interposed in said low-pressure chamber to retain fluff suspended in the drying air. Said air-filtering device comprises a filtering element through which the drying air passes, means to cause the detachment of fuzz attached to said filtering element and a build-up enclosure, wherein the detached fuzz falling off the filtering element is collected. In said casing there is a cleaning opening in communication with said build-up enclosure of the filtering device, and said cleaning opening is configured to receive a suction nozzle of an external suction device to remove the fluff from the build-up enclosure through suction, which can be carried out without the need of removing the filtering element or accessing it.

With this arrangement, the means to cause the detachment of the fluff attached to the filtering element can be activated, for instance, at the end of every tumbling cycle, and the removal of fluff from the build-up enclosure through the cleaning opening by means of said suction nozzle can be carried out after a predetermined number of tumbling cycles. This way, the filtering element is substantially free of fluff at the start of every tumbling cycle and the fluff can be eliminated every time it is deemed necessary in a fast, easy, comfortable and clean manner without the need to remove the filter or to access it.

Various air-filtering devices for tumble dryers are well known in the prior art, any of which is applicable to the industrial tumble dryer of the present invention. A known example is an air-filtering device wherein the filtering element has the shape of a filter sheet or wall that is affixed to a frame arranged in a passing section of the drying air. In another example, the filtering device has the shape of a drawer provided with filtering walls through which the drying air goes from the inside out of the drawer. Yet another example is a filtering device in the shape of a sleeve or bag with filtering walls made of a filter sheet wherein the drying air circulates therethrough from the inside out. Other constructions for the air-filtering device, as well as the use of other filtering elements applicable to an industrial tumble dryer, can occur to one skilled in the art without departing from the scope of the present invention.

As a mean to cause the detachment of fluff attached to the filtering element, any one of the various known systems of the prior art can be used. For instance, the use of one or more vibrating devices connected to a frame wherein the filtering element is supported, or directly connected to the filtering element, or one or more brushes or other scraping elements moved by mechanical devices going through the surface of the filtering element on the side thereof wherein the fluff builds up, or the use of a filtering element in the shape of a flexible filter sheet supported in a relatively loose manner to facilitate it experiencing tremors and/or jolts each time the circulation of drying air is started or stopped, or even the implementation of means to cause an airflow to go through the filtering element in the opposite direction to that of the drying airflow, among others.

The fluff build-up enclosure can be any fixed compartment or movable container located inside the tumble dryer casing, below the filtering device or integrated into it, and sized to collect the fluff detached from the filtering element or elements through any of the previously described means, or others, and which usually falls by gravity. The cleaning opening provided in the casing of the industrial tumble dryer of the present invention is formed in an outside panel of the casing and can be communicated with the build-up enclosure either in a substantially direct manner or through a connecting duct inside the casing. Since in industrial tumble dryers the filtering device is usually found in a lower region of the casing, below the drum, and the build-up enclosure is arranged below the filtering device, a substantially direct communication of the cleaning opening with the build-up enclosure implies that the cleaning opening be situated in a lower position of any of the front, rear, right or left sides of the casing. With the use of an internal connecting duct to connect the cleaning opening with the build-up enclosure, the cleaning opening can be located at any height and in any position of any of the front, rear, right or left sides, or even in the top of the casing, which is an advantage when a portable vacuum cleaner is used as an external suction device to remove the fluff from the build-up enclosure by suction.

When the use of a portable vacuum cleaner is foreseen, the cleaning opening provided in an outside panel of the casing is associated to a coupling piece situated inside the casing and includes a lid. Said coupling piece has a conical section, with a larger sized end connected to an inner side of the casing around the cleaning opening and a smaller sized end in communication with the build-up enclosure wherein the fluff detached from the air-filtering device builds up. The conical section of the coupling piece is universal and is configured to receive the coupling of suction nozzles, generally cylindrical or slightly conical, having a diameter range customary among the suction nozzles provided with the majority of commercially available portable vacuum cleaners. This way, by simply introducing the suction nozzle of the portable vacuum cleaner through the cleaning opening until it makes contact with the conical section of the coupling piece and keeping it slightly pressed against the latter, a fast, automatic coupling is achieved with enough air-tightness between the suction nozzle and the coupling piece. Once the cleaning operation is deemed finished, the coupling between the suction nozzle and the coupling piece is automatically undone by simply removing the suction nozzle from the cleaning opening.

Said lid serves the purpose of closing the cleaning opening when the suction nozzle is not being used, and it keeps the low-pressure chamber from drawing in outside air through the cleaning opening during a tumbling cycle. This lid is preferably installed in an outer part of the casing and attached to it through a pivot or guide means that allow the lid to be moved between a closed position, wherein the lid is opposite the cleaning opening, entirely covering it, and an open position, wherein the lid is sufficiently withdrawn from the cleaning opening to allow the introduction of the suction nozzle through it. When the lid is in the closed position, the suction produced by the low-pressure chamber keeps it pressed against an area of the casing around the cleaning opening, ensuring sufficient air-tightness, optionally in cooperation with a gasket were it deemed necessary.

Alternatively, if the use of a fixed or stationary suction system is foreseen as the external suction device, said fixed suction system will then be provided with at least one suction duct to one of whose ends the suction nozzle will be connected, and the suction nozzle will be connected in a permanent manner to the cleaning opening. In this case, this makes the lid and the coupling piece associated to the cleaning opening unnecessary.

BRIEF DESCRIPTION OF THE DRAWINGS

The above and other features and advantages will be more fully understood from the following detailed description of exemplary embodiments with reference to the attached drawings, wherein.

DETAILED DESCRIPTION OF EXEMPLARY EMBODIMENTS

Figure 1:
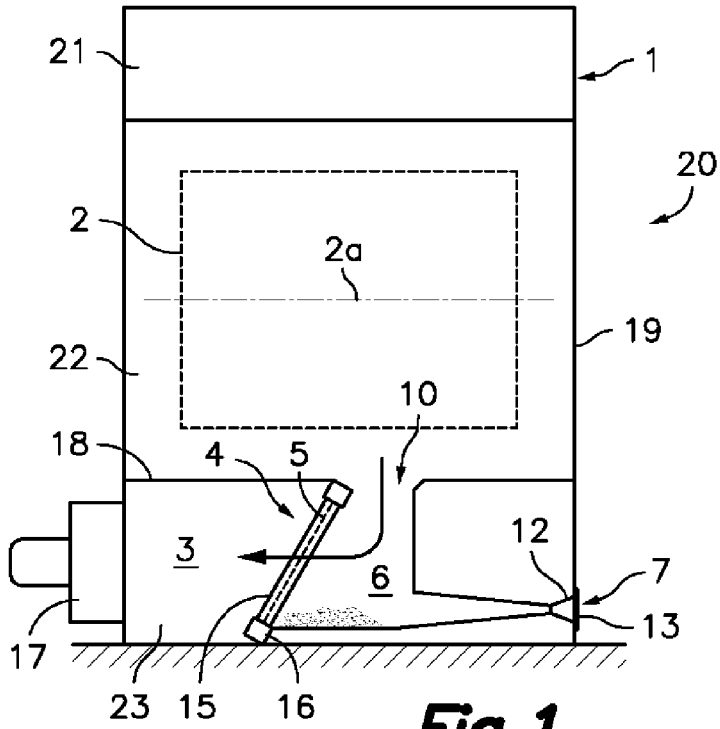
FIG. 1 is a schematic side view of an industrial tumble dryer with a filter-cleaning device according to an embodiment of the present invention.
Figure 2:
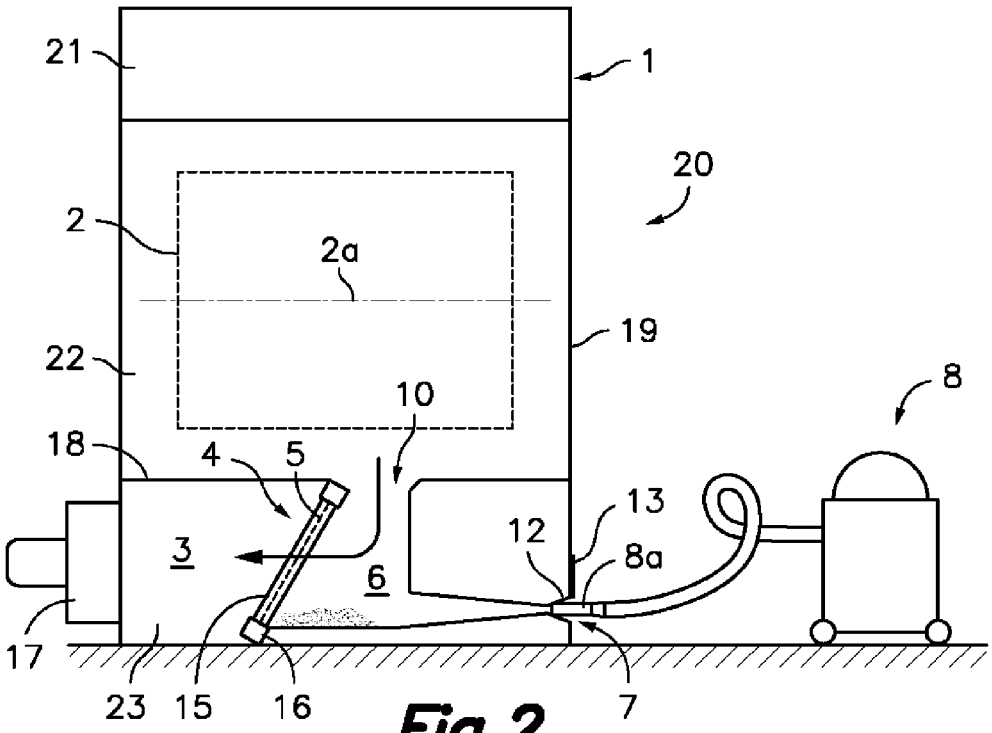
FIG. 2 is a schematic side view of the industrial tumble dryer of FIG. 1 during the cleaning operation in cooperation with a portable vacuum cleaner.
Figure 3:
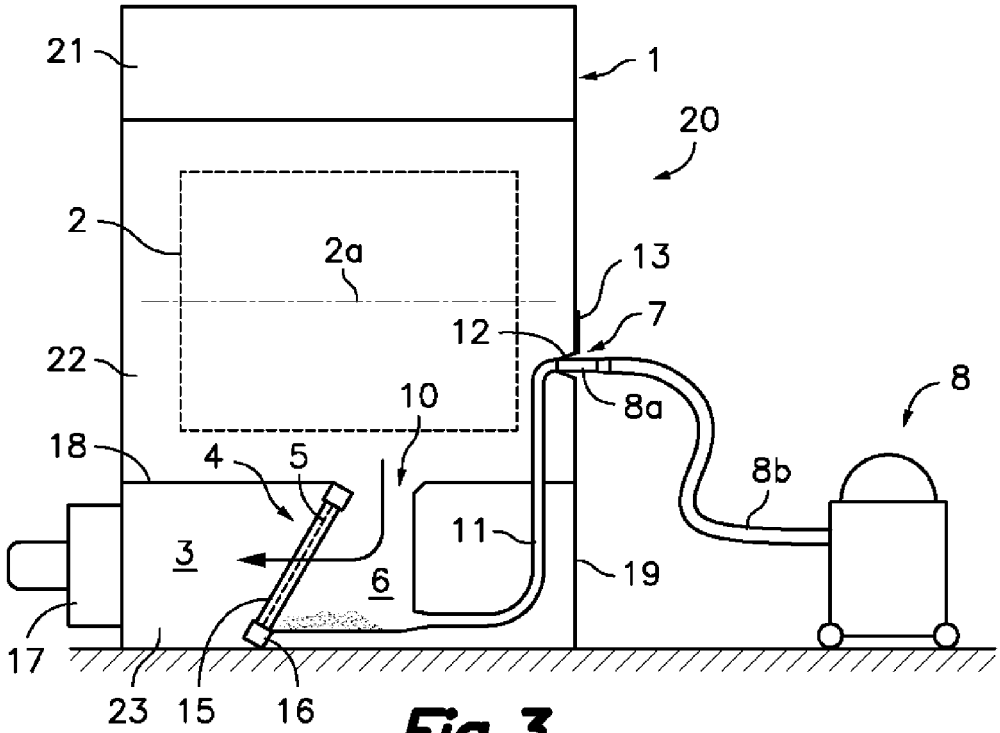
FIG. 3 is a schematic side view of an industrial tumble dryer with a filter-cleaning device according to another embodiment of the present invention during a cleaning operation in cooperation with a portable vacuum cleaner.
Figure 4:
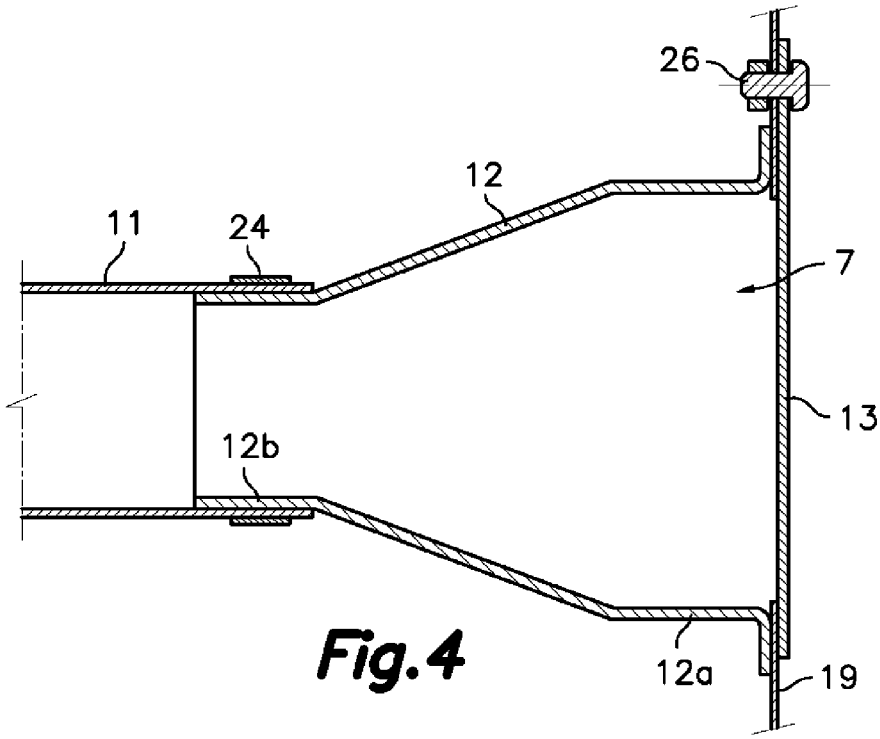
FIG. 4 is a partial cross-sectional view, taken along an axial plane, of a cleaning opening in the casing of the tumble dryer of FIG. 1, 2 or 3, with a lid and a coupling piece associated to it, in an inactive situation.
Figure 5:
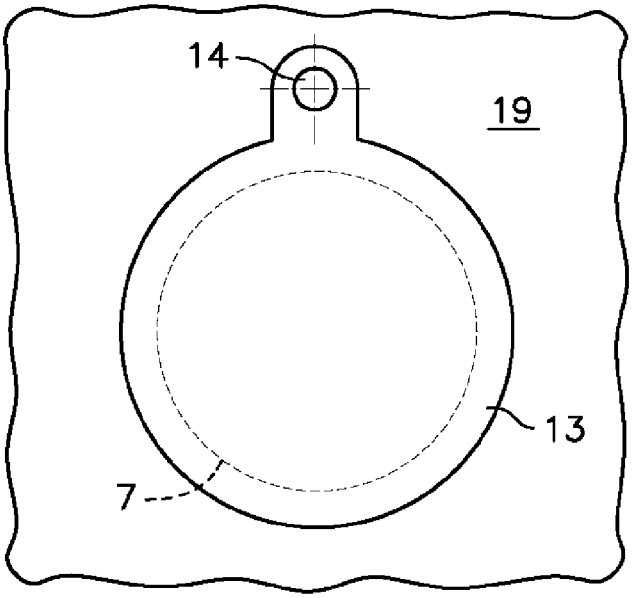
FIG. 5 is a partial frontal view from outside of the lid associated to the cleaning opening in the inactive situation of FIG. 4.

Referring first to FIGS. 1, 2 and 3, reference number 20 designates generally an industrial tumble dryer that, in essence, comprises an outside casing 1 inside which three main regions are delimited: an upper region 21 wherein air-heating means (not shown) are housed, a middle region 22 wherein the tumbling drum 2 is located to contain clothes to be dried by means of drying air coming from the air-heating means and introduced into it, and a lower region 23 wherein a low-pressure chamber 3 through which hot air coming from said tumbling drum 2 circulates is located. The drying air is generally air heated by the heating means, although it can optionally be air at room temperature. The drying air coming from the middle region 22 accesses the lower region 23 through at least one air inlet 10, which, in the illustrated embodiment, is formed in an inside panel 18 although it could alternatively adopt other configurations and arrangements. A turbine 17 or the like is arranged in communication with the low-pressure chamber 3 to create low pressure in it, thereby impelling drying air through the drum 2, the air inlet 10 and the low-pressure chamber 3 to finally expel the drying air outside. Inside the low-pressure chamber 3 an air-filtering device 4 is interposed to retain fluff detached from the clothes and suspended in the drying air. That way, the drying air goes through the air inlet 10 and accesses the low-pressure chamber 3 passing through the filtering device, as indicated by means of an arrow in FIGS. 1, 2 and 3. In general, the tumble driver includes motor-driven actuation means to rotate the drum 2 about a horizontal or slightly inclined axis 2*a*. The configuration and operation of the air-heating means and the duct means through which the drying air coming from the upper region 21 is led through the drum 2 and towards the low-pressure chamber 3 can be of very different forms well-known in the state of the art and do not form part of the present invention, so their detailed description will be omitted. Likewise, the arrangement of regions of the industrial tumble dryer can vary relative to the ones illustrated without affecting the scope of the present invention.

The air-filtering device 4 depicted in FIGS. 1, 2 and 3 responds to a known configuration and it comprises a rigid frame 15 surrounding and supporting a filtering element 5 in the shape of a filter sheet (schematically represented by a dashed line in FIG. 1). This rigid frame 15 is supported above a build-up enclosure 6, and one or more vibration-generating devices 16 are connected to said rigid frame 15. When they are on, the vibration-generating devices 16 cause the rigid frame 5 to vibrate and it, in turn, causes the filtering element 5 to vibrate, thereby causing the fluff attached to the filtering element 5 to become dislodged and fall inside said build-up enclosure 6. In the illustrated embodiments, the rigid frame 15 supporting the filtering element 5 is supported in an inclined position, with a lower end thereof situated more downstream than an upper end, and the build-up enclosure 6 is sized to span at least the projection of the filtering element 5 on a horizontal plane and to retain an amount of fluff preferably equivalent to the amount of fluff detached from the filtering element after several tumbling cycles. That way, the fluff that is detached from the filtering element 5 as a result of the vibration imparted by the vibration-generating devices 16 falls by gravity and builds up in the build-up enclosure 6. In the casing 1 there is a cleaning opening 7 in communication with said build-up enclosure 6, and said cleaning opening 7 is configured to receive, via a socket coupling, a suction nozzle 8*a* connected to an end of a flexible suction duct 8*b* of an external portable vacuum cleaner 8, which is used to remove by suction fluff accumulated in the build-up enclosure 6 through the cleaning opening 7 without the need to remove the filtering element 5 or to access it.

In the embodiment shown in FIGS. 1 and 2, the cleaning opening 7 is communicated in a substantially direct manner with the build-up enclosure 6, so that the cleaning opening 7 is situated in a lower region of the casing 1. Depending on the configuration of the casing 1 and the situation of the build-up enclosure 6 inside it, the connection between the cleaning opening 7 and the build-up enclose 6 might be even more direct than that shown in FIGS. 1 and 2. A connection as direct as possible has the advantage of minimising the flow rate losses of the external suction device 8, but it determines the location of the cleaning opening 7 in the casing 1.

In the embodiment shown in FIG. 3, the cleaning opening 7 is communicated with the build-up enclosure 6 through a connecting duct 11, by virtue of which the cleaning opening 7 can be placed almost anywhere in the casing 1 that is not previously occupied by another device. For instance, the cleaning opening 7 can be situated at different heights and positions in any of the front, rear, right or left sides, and also in the top of the casing 1. However, in order to take advantage of the suction capacity of the portable vacuum cleaner 8 to the fullest, it is advisable to seek a position for the cleaning opening 7 that will provide an acceptable ease of access with a connecting duct 11 as short and direct as possible.

In both embodiments illustrated in FIGS. 1, 2 and 3, the industrial tumble dryer includes a lid 13 to close the cleaning opening 7 when the suction nozzle 8*a* is not connected to it, and the cleaning opening 7 is associated to a coupling piece 12 to facilitate a fast coupling with the suction nozzle 8*a* of the portable vacuum cleaner 8.

Figure 6:
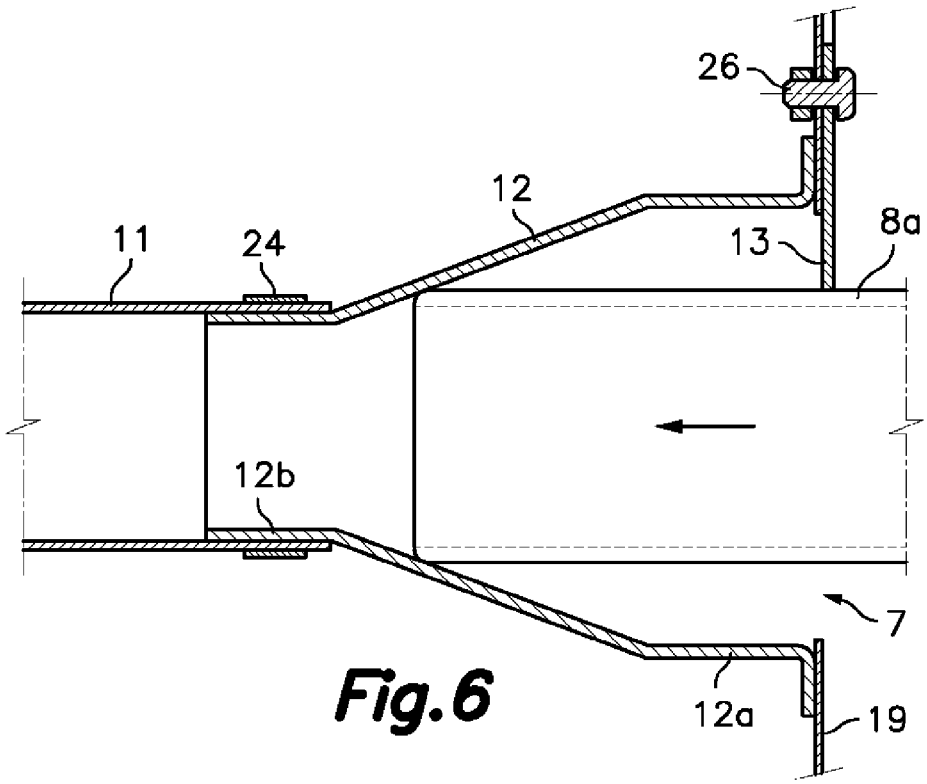
FIG. 6 is a partial cross-sectional view similar to FIG. 4, but in an active situation in cooperation with a suction nozzle of the portable vacuum cleaner.

In FIGS. 4 to 7 there is shown an example of construction of said coupling piece 12 and said lid 13. The cleaning opening 7 is formed in an outside panel 19 of the tumble dryer, and the coupling piece 12 is arranged on an inner side of said outside panel 19, whereas the lid 13 is arranged on an outer side thereof. The coupling piece 12 (FIGS. 4 and 6) has the shape of a funnel and is provided with a conical section with a larger sized end 12*a* connected to an inner side of the outside panel 19 around the cleaning opening 7 and a smaller sized end 12*b* situated more to the inside of the casing 1 and connected to an end of the connecting duct 11, which is in communication with the build-up enclosure 6 according to the embodiment of FIG. 3. Alternatively, the smaller sized end 12*b* of the coupling piece 12 might be communicated in a substantially direct manner with the build-up enclosure 6 according to the embodiment of FIGS. 1 and 2. As shown in FIG. 6, the conical section of the coupling piece 12 is configured to couple with suction nozzles 8*a* of different diameters within a diameter range customary among the suction nozzles of the majority of commercially available portable vacuum cleaners, so that the coupling piece 12 provides a universal coupling.

According to the illustrated embodiment, the lid 13 is formed by a sheet of clearly larger dimensions than the dimensions of the cleaning opening 7, and it is installed on the exterior of the outside panel 19 of the casing 1. The lid 13 is attached to the outside panel 19 by a pivot 14 that allows the lid 13 to be balanced around said pivot 14 between a closed position (shown in FIGS. 4 and 5), wherein the lid 13 is opposite the cleaning opening 7, entirely covering it, and an open position (shown in FIGS. 6 and 7), wherein the lid 13 is sufficiently withdrawn from the cleaning opening 7 to allow the introduction of the suction nozzle 8*a* therein. In the closed position, a peripheral region of the lid 13 is overlaid on a region of the outside panel 19 around the cleaning opening 7, so that, during a tumbling cycle, the suction produced by the low-pressure chamber 3 keeps the lid 13 pressed against the outside panel 19 providing enough air-tightness.

Figure 7:
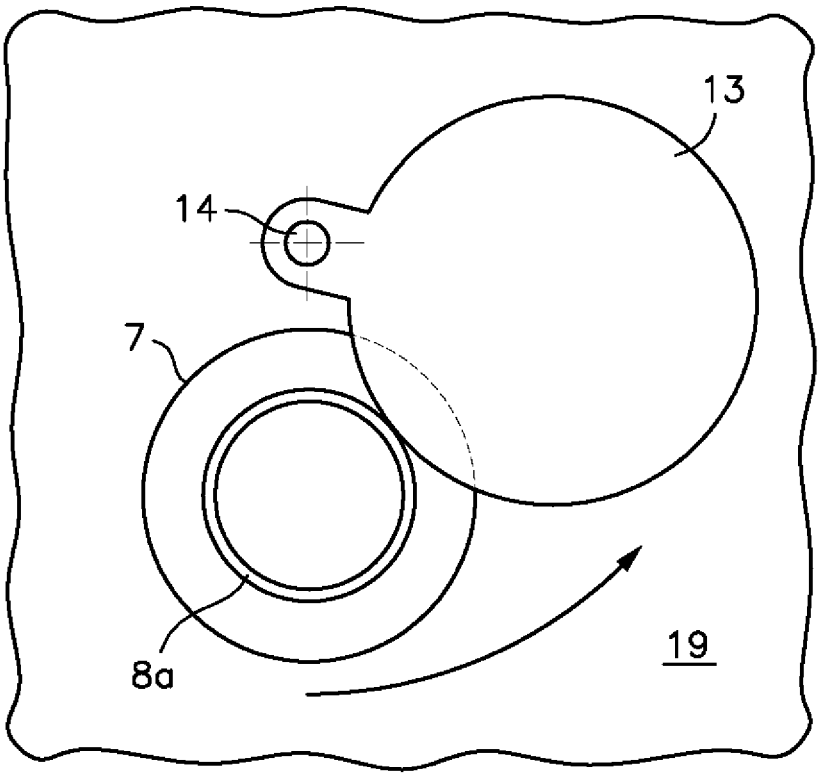
FIG. 7 is a partial frontal view from outside of the lid associated to the cleaning opening in the active situation of FIG. 6.

Advantageously, the pivot 14 is situated above the topmost part of the cleaning opening 7 and vertically aligned with the centre thereof. As a result, the lid 13 has the tendency to automatically return to a closed position and stay in it by gravity. The lid 13 can be pushed from the closed position to the open position using the end of the suction nozzle 8*a* of the portable vacuum cleaner 8, and while the suction nozzle 8*a* is coupled up to the coupling piece 12 associated to the cleaning opening 7, the suction nozzle prevents the movement of the lid 13 towards the closed position (FIG. 7). Alternatively, the closed position of the lid might be delimited by a stop (not shown) and an elastic element (not shown) might be arranged to cause the lid 13 to automatically return to a closed position against said stop, in which case the pivot might be arranged in any position relative to the cleaning opening 7.

According to an alternative embodiment (not shown), the lid is attached to the outside panel of the casing by means of guide elements that allow the lid to be linearly moved between a closed position, wherein the lid is opposite the cleaning opening 7, entirely covering it, and an open position, wherein the lid is sufficiently withdrawn from the cleaning opening 7 to allow the introduction of the suction nozzle 8*a* therein. By delimiting the closed position through a stop and arranging the guide elements in a substantially vertical direction, the lid would tend to automatically return to the closed position and stay in it by gravity. Alternatively, an elastic element could be provided to cause the lid to automatically return to the closed position against said stop, in which case the guide elements might be arranged in any direction.

Variations and modifications to the described embodiments will easily occur to one skilled in the art without departing from the scope of the present invention. For instance, the air-filtering device can alternatively be in the shape of a drawer provided with filtering walls through which the drying air goes from the inside out of the drawer, in which case the build-up enclosure where the fluff accumulates would be a bottom wall of said drawer. Another alternative example is a filtering device in the shape of a sleeve or bag with filtering walls wherein the drying air circulates therethrough from the inside out.

The scope of the present invention is defined in the enclosed claims.

The invention claimed is:

1. An industrial tumble dryer with a filter-cleaning device comprising a casing (1) wherein the following elements are found: a drum (2); means for introducing drying air into said drum (2) for drying clothes contained within the drum (2); a low-pressure chamber (3); means for drawing in said drying air from said drum (2) with the low-pressure chamber; and an air-filtering device (4) interposed in said low-pressure chamber (3), said air-filtering device (4) comprising a filtering element (5) means for retaining fuzz suspended in the drying air by attachment of the fuzz to said filtering element (5); means for causing detachment of the fuzz from said filtering element (5) with the filtering element (5) interposed in the low-pressure chamber (3), and a build-up enclosure (6) positioned with respect to the filtering element (5) to collect the detached fuzz falling off the filtering element (5) in response to the detachment of the fuzz from the filtering element (5) by said means for causing detachment of the fuzz so as to enable the fuzz to fall off the filtering element (5) and into said build-up enclosure (6); a cleaning opening (7) provided in said casing (1) in communication with said build-up enclosure (6), said cleaning opening (7) being configured to receive by socket coupling a suction nozzle (8*a*) of a portable vacuum cleaner (8) to remove the fuzz from the build-up enclosure (6) through suction with the filtering element (5) interposed in the low-pressure chamber (3); and a lid (13) associated with the casing (1) for closing the cleaning opening (7) when said suction nozzle (8*a*) of said portable vacuum cleaner is not connected to the cleaning opening (7).

2. The industrial tumble dryer according to claim 1, wherein said lid (13) is installed on an outer part of the casing (1) and attached to it by a pivot (14) or guide means that allow the lid (13) to be moved between a closed position, wherein the lid (13) is opposite the cleaning opening (7), covering it, and an open position, wherein the lid (13) is sufficiently withdrawn from the cleaning opening (7) to allow the introduction of the suction nozzle (8*a*) in it.

3. The industrial tumble dryer according to claim 1, wherein the cleaning opening (7) is associated to a coupling piece (12) provided with a conical section having a larger sized end (12*a*) connected to an inner side of the casing (1) around the cleaning opening (7) and a smaller sized end (12*b*) inside the casing (1) and in communication with the build-up enclosure (6).

4. The industrial tumble dryer according to claim 3, wherein said conical section of the coupling piece (12) is configured to couple with suction nozzles (8*a*) of a size range.

5. The industrial tumble dryer according to claim 1, wherein the cleaning opening (7) is directly communicated with the build-up enclosure (6).

6. The industrial tumble dryer according to claim 1, wherein the cleaning opening (7) is communicated with the build-up enclosure (6) by means of a connecting duct (11) inside the casing (1).

* * * * *